United States Patent [19]

Whitehead

[11] Patent Number: 4,542,449

[45] Date of Patent: Sep. 17, 1985

[54] LIGHTING PANEL WITH OPPOSED 45° CORRUGATIONS

[75] Inventor: Lorne A. Whitehead, Vancouver, Canada

[73] Assignee: Canadian Patents & Development Limited, Ottawa, Canada

[21] Appl. No.: 527,495

[22] Filed: Aug. 29, 1983

[51] Int. Cl.[4] ..... F21V 5/02

[52] U.S. Cl. ..... 362/330; 362/308; 362/311; 362/331; 362/339

[58] Field of Search ..... 362/308, 330, 331, 332, 362/339, 311

[56] References Cited

U.S. PATENT DOCUMENTS

| | | | |
|---|---|---|---|
| 2,154,868 | 4/1939 | Saint Genies | 362/331 X |
| 2,474,317 | 6/1949 | McPhail . | |
| 3,234,376 | 2/1966 | Ceglia | 362/330 |
| 4,064,433 | 12/1977 | Korn . | |
| 4,233,651 | 11/1980 | Fabbri | 362/330 X |
| 4,260,220 | 4/1981 | Whitehead . | |

FOREIGN PATENT DOCUMENTS

| | | | |
|---|---|---|---|
| 1021802 | 12/1952 | France | 362/331 |

*Primary Examiner*—Peter A. Nelson
*Attorney, Agent, or Firm*—Edward Rymek

[57] ABSTRACT

The lighting panel has a first face for receiving light from a source and a second face. The panel includes a first and a second sheet of transparent dielectric material. Each sheet has a smooth surface on one side and is corrugated on the other side. The surfaces forming the corrugations intersect at 90° the smooth surface on the first side is at 45° to the surfaces of the corrugations on the other side of each sheet. The smooth surface of the first sheet forms the first face of the panel, the corrugated surface of the first sheet is adjacent to the smooth surface of the second sheet, with the direction of the corrugations on the second sheet set at a predetermined angle $\alpha$ to the direction of the corrugations on the first sheet. Light thus enters the smooth surface of the first sheet and emerges from the corrugated surface of the second sheet. The sheets may be substantially planar. At least one of the sheets may also include light release mechanisms. The angle $\alpha$ may be set at substantially 90°, or may be varied to produce a desired light directionality.

5 Claims, 5 Drawing Figures

LIGHTING PANEL WITH OPPOSED 45° CORRUGATIONS

BACKGROUND OF THE INVENTION

This invention is directed to a lighting panel for distributing light from lighting fixtures or luminaires and, in particular, to a lighting panel for diffusing the light with a desired directionality.

Lighting panels have been in use for many years particularly in fluorescent light fixtures. Prismatic lighting panels which have had some success in reducing direct glare by controlling the angle at which light emerges are described in U.S. Pat. No. 2,474,317, which issued on June 28, 1947 naming the inventor R. G. McPhail, as well as U.S. Pat. No. 4,064,433 which issued on Dec. 20, 1977, naming the inventor William W. Korn.

SUMMARY OF THE INVENTION

It is an object of this invention to provide a lighting panel in which the emerging light has a predetermined directionality.

This and other objects are achieved in a lighting panel having a first face to be positioned to receive light from a source and a second face. The panel includes a first and a second sheet of transparent dielectric material, each sheet having a first smooth surface on one side and a corrugated surface on the other side, wherein the corrugated surfaces intersect at 90° and the surfaces of the corrugations are at 45° to the smooth surface on the one side. The smooth surface of the first sheet forms the first face of the panel and the corrugated surface of the first sheet is positioned adjacent to the smooth surface of the second sheet. The direction of the corrugations on the second sheet are at a predetermined angle $\alpha$ to the direction of the corrugations on the first sheet, whereby distributed light enters the smooth surface of the first sheet and emerges from the corrugated surface of the second sheet.

In accordance with another aspect of the present invention the sheets are substantially planar. In addition, at least one of the sheets can include light release mechanisms. The angle $\alpha$ can be substantially 90° to provide maximum directionality, or the two sheets may be rotatable with respect to one another to vary the angle $\alpha$ to change the directionality.

Many other objects and aspects of the invention will be clear from the detailed description of the drawings.

DETAILED DESCRIPTION

Figure 1:
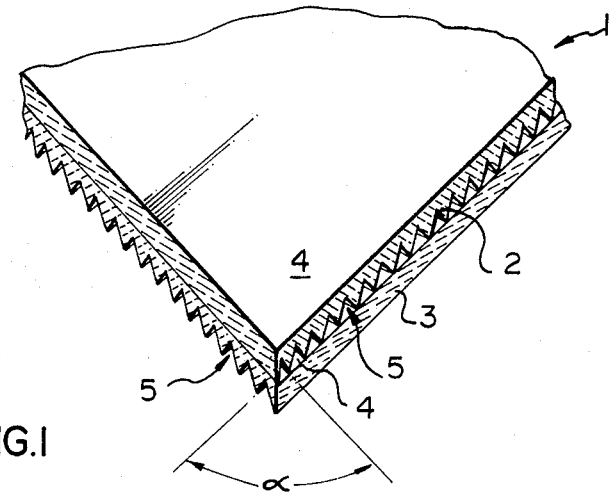
FIG. 1 illustrates a section of the lighting panel in accordance with the present invention.

The lighting panel 1 as shown in FIG. 1 is made from two sheets 2, 3 of transparent dielectric material. Each sheet has a first smooth surface 4 and a second corrugated surface 5. The surfaces 4 and 5 are made such that the surfaces of the corrugations on the second surface 5 intersect at 90°, and the surfaces of the corrugations are further at 45° to the smooth surface 4.

The smooth surface 5 of the first sheet 2 will be used to receive the light from a source and will thus be the first or upper face of the panel 1. The smooth surface 5 of the second sheet 3 is adjacent the corrugated surface 4 of the first sheet 2. Some of the light that is distributed from the panel 1 will, therefore, emerge from the corrugated surface of the second sheet 3. The sheets 2, 3 are placed one over the other such that the direction of the corrugations on the sheets 2, 3 are at a predetermined angle $\alpha$ to one another.

Although maximum control of the light distribution occurs for $\alpha=90°$, a less controlled distribution may be desirable and can be obtained by setting the angle $\alpha$ to be less than 90°.

The origin of this light control is similar to that obtained with conventional single layer diffusion panels such as those referred to above, in which light that would otherwise emerge at angles deviating considerably from the direction perpendicular to the panel (hereafter termed the "normal") is substantially reflected back toward the light source, with the reflection resulting in part from total internal reflections, and in part from partial internal reflections.

There are two main differences by which panel 1 differs from conventional prismatic sheets, and which result in better light control. The first is that the corrugated sheets have the property known as "octature", which is described in U.S. Pat. No. 4,260,220 that issued on Apr. 7, 1981, naming Lorne Whitehead as inventor, and which patent is incorporated herein by reference. In such a sheet, surfaces on one side of the sheet are all parallel or perpendicular to one another, the surfaces on the other side of the sheet are all parallel or perpendicular to one another, and the surfaces on one side of the sheet are at 45° to the surfaces on the other side of the sheet. Such a panel 1 has the special property that light rays which undergo any number of partial internal reflections in the panel maintain the same angular relationship to the surfaces as they originally had. Other lighting panels do not have this property, and as a result light rays resulting from several partial internal reflections are essentially uncontrolled.

In a single octature sheet, however, a smaller degree of light control is exhibited in the perpendicular plane parallel to the prism direction than in the perpendicular plane at right angles to the prism direction. Therefore, the pane. 1 in accordance with the present invention, in which two sheets are positioned with the corrugations at an angle $\alpha$ to one another, effective directional control is obtained. This directional control obtained from two sheets, is the second main difference between the present invention and conventional lighting panels.

Figure 2:
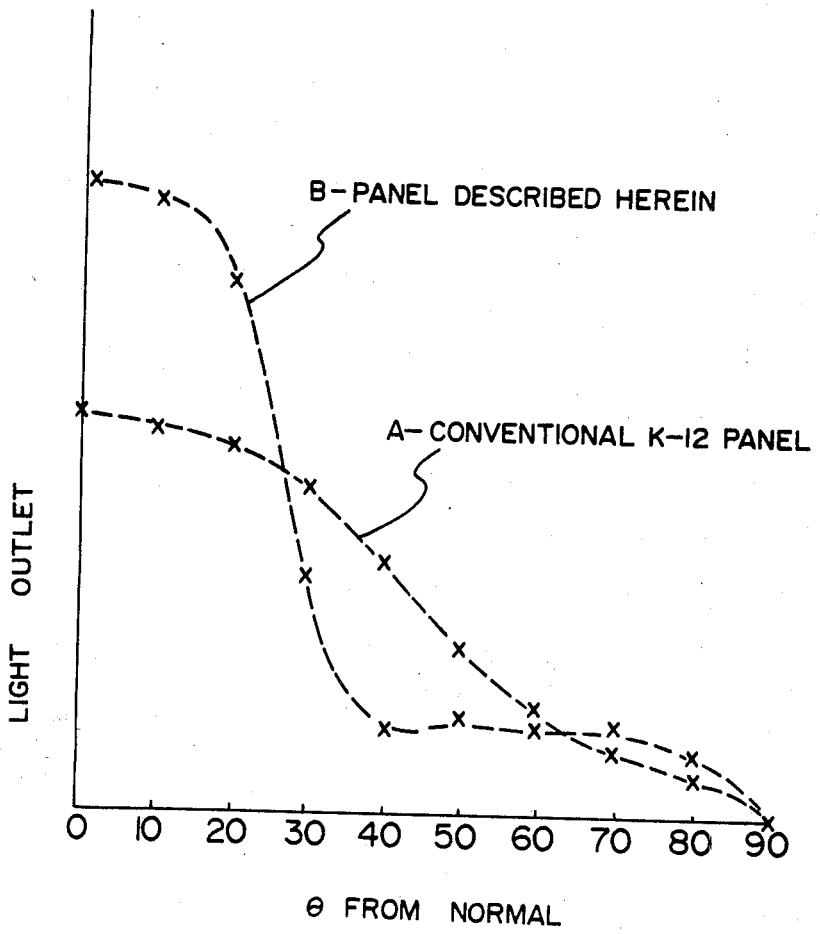
FIG. 2 is a graph of light output versus angle from the normal.

FIG. 2 is a graph of light output versus angle from the normal for conventional K-12 prismatic panel—line A, and for a panel in accordance with the present invention—line B. As can be seen, the main concentration of light for the panel in accordance with the present invention lies in the region within 30° of the normal. The concentration of light for the K-12 panel decreases almost linearly from 0° to 90°.

Figure 4:
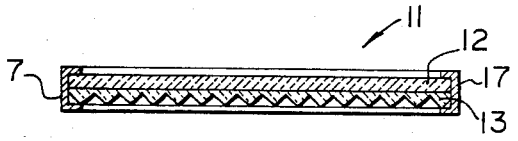
FIGS. 3 and 4 illustrates a fixed sheet lighting panel.
Figure 3:
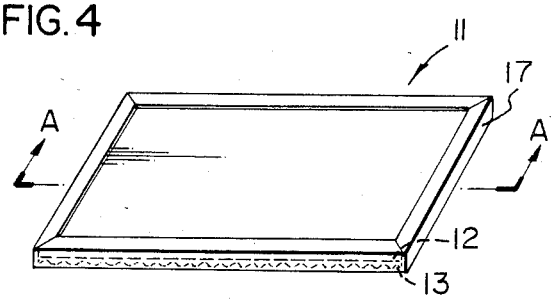

The panels may be made either with the two sheets rigidly fixed with respect to one another, or with the sheets movable such that they may be rotated with respect to one another. FIGS. 3 and 4 illustrate a fixed sheet panel 10, FIG. 4 being a cross-section taken along section A—A of FIG. 3. This fixed panel 11 is shown with $\alpha = 90°$. The sheets 12 and 13 are fixed together by a U-shaped channel 17 which may be press-fitted or glued around the edge of the panel 11.

Figure 5:
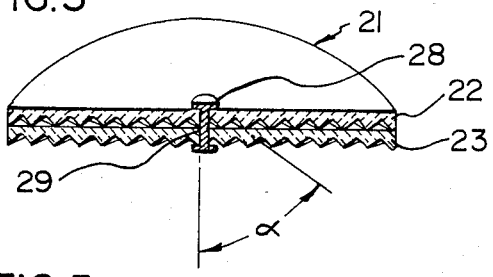
FIG. 5 illustrates a circular lighting panel.

In FIG. 5, a circular panel 21 is shown wherein a first sheet 22 is attached to a second sheet 23 by a loosely fitting rivet or bolt 28 passing through the two sheets 22, 23 at a pivot point 29 at the centers of the sheets 22, 23. This allows the angle $\alpha$ to be adjusted as desired.

Such a panel can clearly be useful in controlling the light emanating from conventional fluorescent lamps. The panel, in accordance withe the present invention, can, however, also be used with luminaires described in a co-pending patent application entitled, "Prism Light Guide Luminaire" filed on even date naming Lorne A. Whitehead as inventor. This luminaire is used with a prism light guide as described in U.S. Pat. No. 4,260,220 which issued Apr. 7, 1981, also naming Lorne A. Whitehead as inventor. In the luminaire described in the above noted copending application, which is incorporated herein by reference, at least one of the luminaire sheets is made from a transparent dielectric material sheet with one surface smooth and one surface corrugated. However, the sheet has light release mechanisms incorporated into it such that light travelling through the guide with a directional angle of less than $\theta$, that is in the order of 30°, may be directly released or redirected so as to emerge from the luminaire. These release mechanisms include having non-planar surfaces particularly on the corrugated surfaces, rounded corners in the corrugations and/or roughness of the surfaces of the sheets again primarily on the corrugated surfaces.

In order to assure proper directionality to reduce glare, a second sheet of transparent dielectric material as described above may be fixed to the light emitting surface of the luminaire to produce a light emitting panel essentially as described with respect to the present invention.

Many modifications in the above described embodiments of the invention can be carried out without departing from the scope thereof and, therefore, the scope of the present invention is intended to be limited only by the appended claims.

I claim:

1. A lighting panel having a first face to be positioned to receive light from a source and a second face, comprising:

a first and a second sheet of transparent dielectric material, each sheet having a first smooth surface and a second corrugated surface wherein the surfaces of the corrugations interact at 90° and the surfaces of the corrugations are at 45° to the first smooth surface, the smooth surface of the first sheet forming the first face of the panel and the corrugated surface of the first sheet being of substantially equal size adjacent the smooth surface of the second sheet with the direction of the corrugations on the second sheet being at a predetermined angle $\alpha$ greater than 0° but less than 180° to the direction of the corrugations on the first sheet, whereby distributed light enters the smooth surface of the first sheet and emerges from the corrugated surface of the second sheet.

2. A panel as claimed in claim 1 wherein the sheets are substantially planar.

3. A panel as claimed in claim 1 wherein at least one of the sheets includes light release mechanisms.

4. A panel as claimed in claim 1 wherein the angel $\alpha$ is substantially 90°.

5. A panel as claimed in claim 1 wherein the second sheet adjusts relative to the first sheet to vary the angle $\alpha$.

* * * * *

UNITED STATES PATENT AND TRADEMARK OFFICE

CERTIFICATE OF CORRECTION

PATENT NO. : 4,542,449

DATED : September 17, 1985

INVENTOR(S) : Lorne A. Whitehead

It is certified that error appears in the above-identified patent and that said Letters Patent are hereby corrected as shown below:

Column 4, line 15: "interect" should read "intersect".

This certificate supersedes certificate of correction issued August 5, 1986.

Signed and Sealed this

Sixteenth Day of December, 1986

*Attest:*

DONALD J. QUIGG

*Attesting Officer* *Commissioner of Patents and Trademarks*